United States Patent [19]

Steidl et al.

[11] Patent Number: 4,949,549

[45] Date of Patent: Aug. 21, 1990

[54] COOLING DEVICE WITH IMPROVED WASTE-HEAT HANDLING CAPABILITY

[75] Inventors: Gary V. Steidl, Olivenhain; Cullen M. Sabin, San Diego; Dennis A. Thomas, Malibu, all of Calif.

[73] Assignee: International Thermal Packaging, Inc., Carlsbad, Calif.

[21] Appl. No.: 420,337

[22] Filed: Oct. 12, 1989

Related U.S. Application Data

[63] Continuation-in-part of Ser. No. 208,371, Jun. 22, 1988, Pat. No. 4,901,535, which is a continuation-in-part of Ser. No. 70,973, Jul. 7, 1987, Pat. No. 4,759,191.

[51] Int. Cl.[5] ..... F25B 17/08

[52] U.S. Cl. ..... 62/101; 62/480

[58] Field of Search ..... 62/48.1, 101, 111, 480, 62/337, 502, 457.2, 475.9

[56] References Cited

U.S. PATENT DOCUMENTS

| | | | |
|---|---|---|---|
| 2,144,441 | 1/1939 | Schlumbohm . | |
| 2,871,674 | 2/1959 | Koivisto et al. . | |
| 3,316,736 | 5/1967 | Biermann . | |
| 3,642,059 | 2/1972 | Greiner . | |
| 3,726,106 | 4/1973 | Jaeger . | |
| 3,950,960 | 4/1976 | Kawam . | |
| 3,967,465 | 7/1976 | Asselman et al. . | |
| 3,970,068 | 7/1976 | Sato . | |
| 4,126,016 | 11/1978 | Greiner . | |
| 4,205,531 | 6/1980 | Brunberg et al. . | |
| 4,250,720 | 2/1981 | Siegel . | |
| 4,682,476 | 7/1987 | Payre et al. . | |
| 4,759,191 | 7/1988 | Thomas et al. | 62/337 X |

FOREIGN PATENT DOCUMENTS

| | | |
|---|---|---|
| 2095386 | 9/1982 | United Kingdom . |

*Primary Examiner*—Henry A. Bennet
*Assistant Examiner*—John Sollecito
*Attorney, Agent, or Firm*—Knobbe, Martens, Olson & Bear

[57] ABSTRACT

Disclosed is a self-contained, rapid cooling device that can be stored for indefinite periods without losing its cooling potential. A liquid in a first chamber undergoes a change of phase into vapor which cools the first chamber. A sorbent in a second chamber is in fluid communication with the vapor and removes the vapor from the first chamber. A heat sink material thermally coupled to the sorbent collects and irreversibly captures heat transferred from the vapor to the sorbent.

5 Claims, 1 Drawing Sheet

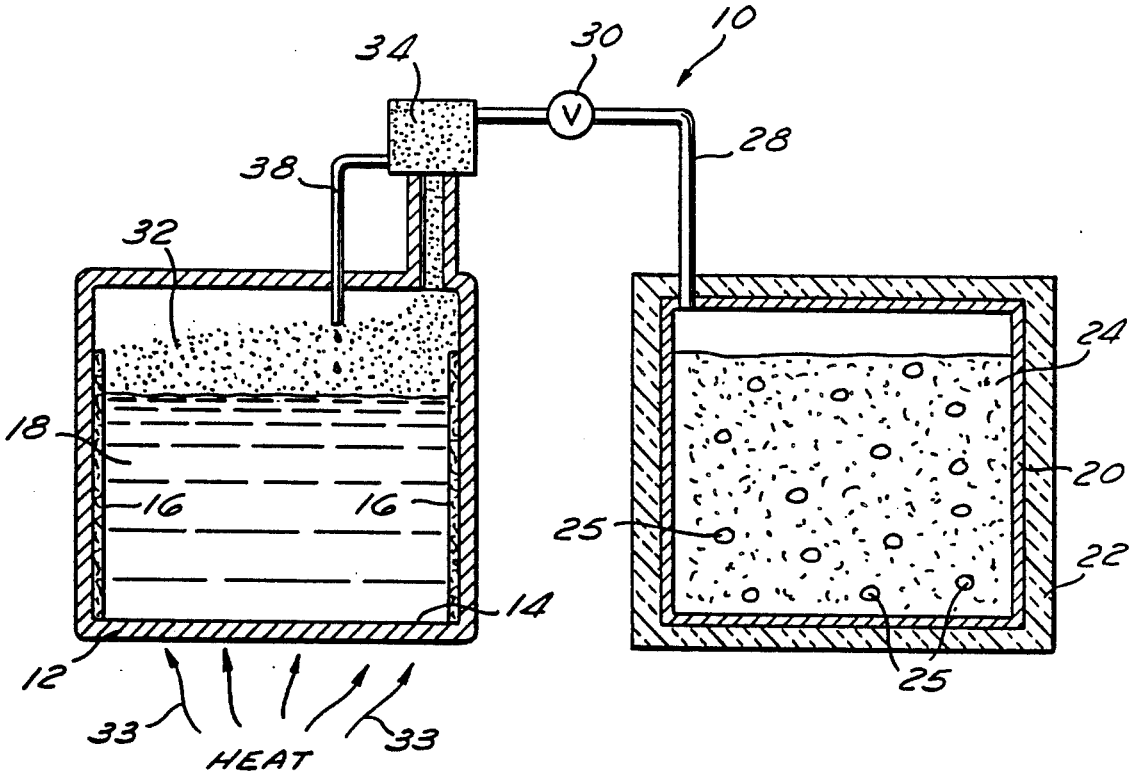
10
30
34
V
28
38
32
24
18
20
16
16
25
22
14
12
25
33
HEAT
33

COOLING DEVICE WITH IMPROVED WASTE-HEAT HANDLING CAPABILITY

RELATED APPLICATIONS

This application is a continuation-in-part of U.S. application Ser. No. 208,371, filed June 22, 1988 now U.S. Pat. No. 4,901,530 which is a continuation-in-part of U.S. Application Ser. No. 070,973, filed July 7, 1987, now U.S. Pat. No. 4,759,191.

BACKGROUND OF THE INVENTION

The invention relates to temperature changing devices and, in particular, to portable or disposable food or beverage coolers.

There are many foods and beverages that may be stored almost indefinitely at average ambient temperature of 20°–25°C. but that should be cooled immediately before consumption. In general, the cooling of these foods and beverages is accomplished by electrically-run refrigeration units. The use of these units to cool such foods and beverages is not always practical because refrigerators generally require a source of electricity, they are not usually portable, and they do not cool the food or beverage quickly.

An alternate method for providing a cooled material on demand is to use portable insulated containers. However, these containers function merely to maintain the previous temperature of the food or beverage placed inside them, or they require the use of ice cubes to provide the desired cooling effect. When used in conjunction with ice, insulated containers are much more bulky and heavy than the food or beverage. Moreover, in many locations, ice may not be readily available when the cooling action is required.

Ice cubes have also been used independently to cool food or beverages rapidly. However, utilization of ice independently for cooling is often undesirable because ice may be stored only for limited periods above 0° C. Moreover, ice may not be available when the cooling action is desired.

In addition to food and beverage cooling, there are a number of other applications for which a portable cooling device is extremely desirable. These include medical applications, including cooling of tissues or organs; preparation of cold compresses and cryogenic destruction of tissues as part of surgical procedures; industrial applications, including production of cold water or other liquids upon demand; preservation of biological specimens; cooling of protective clothing; and cosmetic applications. A portable cooling apparatus could have widespread utility in all these areas.

Most attempts to build a self-contained miniaturized cooling device have depended on the use of a refrigerant liquid stored at a pressure above atmospheric pressure, so that the refrigerant vapor could be released directly to the atmosphere. Unfortunately, many available refrigerant liquids for such a system are either flammable, toxic, harmful to the environment, or exist in liquid form at such high pressures that they represent an explosion hazard in quantities suitable for the intended purpose. Conversely, other available refrigerant liquids acceptable for discharge into the atmosphere (such as carbon dioxide) have relatively low heat capacities and latent heats of vaporization. As a result, some cooling devices which release carbon dioxide are more bulky than is commercially acceptable for a portable device.

An alternate procedure for providing a cooling effect in a portable device is to absorb or adsorb the refrigerant vapor in a chamber separate from the chamber in which the evaporation takes place. In such a system, the refrigerant liquid boils under reduced pressure in a sealed chamber and absorbs heat from its surroundings. The vapor generated from the boiling liquid is continuously removed from the first chamber and discharged into a second chamber containing a desiccant or sorbent that absorbs the vapor.

The use of two chambers to produce a cooling effect around one chamber is illustrated in U.S. Pat. No. 4,250,720 to Siegel and Great Britain Patent No. 2,095,386 to Cleghorn, et al. These patents disclose a two-chamber apparatus connected by a tube. The Siegel patent uses water as the refrigerant liquid, while the Cleghorn, et al. patent is not limited to water. The Siegel patent envisions the use of such a cooling device to cool food or beverages.

However, in the Siegel and Cleghorn, et al. patents, the rapid initial cooling effect gradually slows as a result of the both decrease in temperature of the object to be cooled and decrease in the heat transfer area of the first chamber. The decrease in heat transfer area is due to the fact that the portion of the first chamber in contact with the liquid decreases as the liquid vaporizes and the liquid level drops. Moreover, in these systems, the evaporation process is limited by the surface area from which the liquid can boil. In addition, the systems do not effectively minimize the amount of liquid which is entrained in the vapor phase caused by uncontrolled boiling of the evaporating liquid.

Our parent U.S. Pat. No. 4,759,191 discloses a refrigeration system employing a desiccant to absorb the refrigerant vapor. In that refrigeration process, the desiccant evolves heat both from the latent heat of vaporization of the refrigerant and from the chemical reaction heat produced as the liquid condensed from the vapor reacts with the desiccant. Since all desiccants so far found satisfactory for this application deteriorate in their absorptive capabilities as the temperature increases, it is of advantage to refrigeration system compactness to limit the temperature rise of the desiccant to as low a value as possible by removing the chemical reaction heat transferred from the condensed liquid to the dessicant.

Accordingly, one objective of the present invention is to provide a self-contained sorption cooling device with a means to alleviate the decrease in heat transfer as the liquid vaporizes and therefore speed the cooling process.

Another object of the present invention is to accelerate the evaporation process by increasing the surface area from which the liquid can evaporate. As a result, the cooling process will be accelerated as well.

Another object of the present invention is to collect and store heat transferred by the vaporized liquid by the use of a heat sink.

Other objectives will become apparent from the appended drawing and the following Detailed Description of the Invention.

SUMMARY OF THE INVENTION

The present invention is a miniaturized cooling device comprising a first chamber containing a liquid which preferably has a vapor pressure at 20° C. of at least about 9 mm Hg, a second chamber containing a sorbent for the liquid, a conduit connecting the first and second chambers, a valve in the conduit for preventing flow through the conduit between the chambers and means for opening the valve. The second chamber is initially evacuated. Thus, when the valve is opened, the first and second chambers are connected and fluid communication between them is possible. This causes a drop in pressure in the first chamber because the second chamber is evacuated. The drop in pressure causes the liquid in the first chamber to vaporize, and, because this liquid-to-gas phase change can occur only if the liquid removes heat equal to the latent heat of vaporization of the evaporated liquid from the first chamber, the first chamber cools. The vapor passes through the conduit and into the second chamber where it is absorbed and adsorbed by the sorbent. The sorbent also absorbs all of the heat contained in the absorbed or adsorbed vapor, and, if the absorption-adsorption process involves a chemical reaction, the sorbent must also absorb the reaction heat. The heat absorbed and adsorbed by the sorbent is in turn collected by a heat sink material in association with the sorbent, thereby slowing the temperature rise of the sorbent.

In a preferred embodiment, the liquid is water, and the first chamber's interior surface may be provided with a wicking material for the liquid. It is preferred that the wicking material lines the interior surface of the first chamber and consists of a highly hydrophilic material, such as gel-forming polymers and water-wicking polymers capable of coating the interior of the first chamber.

In one embodiment of the invention, the liquid is mixed with a nucleating agent that promotes ebullition of the liquid. A phase separator for preventing unvaporized liquid from the first chamber from passing through the conduit into the second chamber may advantageously be included in the device. The sorbent material may be an adsorbent or absorbent, and the second chamber preferably contains sufficient sorbent to absorb or adsorb substantially all of the liquid in the first chamber.

The heat sink material, in association with the sorbent material within the second chamber, then collects heat transferred to the sorbent by the vaporized liquid. The heat sink material may be disposed throughout the chamber, or localized in one area of the second chamber. Preferably, the material is disbursed throughout the chamber and so most preferably compartmentalized to prevent nucleation of the entirety of the material. The entire device is preferably disposable.

In use, the vaporization process causes the level of the liquid in the first chamber to drop, but, in the preferred embodiment, the wicking material retains the liquid on the interior surface of the first chamber. This maintains a substantial area of contact between the liquid and the interior surface of the first chamber to avoid a reduction in the effective heat transfer area of the first chamber and a resultant slowing of the cooling process.

The present invention provides a self-contained rapid cooling device that cools a food, beverage, or other material or article from ambient temperature on demand in a timely manner, exhibits a useful change in temperature, retains a significant portion of the heat produced from the cooling process can be stored for unlimited periods without losing its cooling potential, and is able to meet government standards for safety in human use.

BRIEF DESCRIPTION OF THE DRAWING

The FIGURE is a schematic representation of a cooling device according to the present invention.

DETAILED DESCRIPTION OF THE INVENTION

In FIG. 1, the cooling device 10 has a first chamber 12 lined on the interior surface 14 with a wicking material 16, which, in a preferred embodiment, could be accomplished by flocking or spraying the interior surface 14 with the wicking material 16, and the first chamber 12 is filled with a refrigerant liquid 18. The cooling device 10 also includes a second chamber 20 surrounded by a thermal insulator 22 which is at least partially filled with a sorbent 24 and a heat sink material 40. The second chamber may also advantageously be evacuated to the extent that it contains only the vapor of the refrigerant liquid.

Connecting the first and second chambers 12 and 20 is a conduit 28 and a valve 30 interposed in the conduit 28, allowing fluid communication between the chambers 12 and 20 through the conduit 28 only when the valve 30 is open.

The operation of the cooling device 10 is suspended (i.e., the system is static and no cooling occurs) until the valve 30 is opened, at which time the conduit 28 provides fluid communication between the first and second chambers 12 and 20. Opening the valve 30 between the first and second chambers 10 and 20 causes a drop in pressure in chamber 12 because the second chamber 20 is evacuated. The drop in pressure in the first chamber 12 upon opening of the valve 30 causes the liquid 18 to boil at ambient temperature into a liquid-vapor mixture 32. This liquid-to-gas phase change can occur only if the liquid 18 removes heat equal to the latent heat of vaporization of the evaporated liquid 18 from the first chamber 12. This causes the first chamber 12 to cool. The cooled first chamber 12, in turn, removes heat from its surrounding material as indicated by the arrows 33.

The liquid-vapor mixture 32 is directed through a liquid-vapor collector and separator 34 of conventional design, which separates the liquid 18 from the vapor, allowing the separated liquid 18 to return to the first chamber 12 through the liquid return line 38 and allowing the vapor to pass through the conduit 28 into the second chamber 20. Once inside the second chamber 20, the vapor is absorbed or adsorbed by the sorbent 24. This facilitates the maintenance of a reduced vapor pressure in the first chamber 12 and allows more of the liquid 18 to boil and become vapor, further reducing the temperature of chamber 12. The continuous removal of the vapor maintains the pressure in the first chamber 12 below the vapor pressure of the liquid 18, so that the liquid 18 boils and produces vapor continuously until sorbent 24 is saturated, until the liquid 18 has boiled away or until the temperature of the liquid 18 has dropped below its boiling point.

During the vaporization process, the level of the liquid 18 in the first chamber 12 drops. The wicking material 16 retains the liquid 18 on the interior surface 14 of the first chamber 12 to prevent a reduction in the area of contact between the liquid 18 and the interior surface 14 which would cause a reduction in the effective heat transfer surface area of the first chamber 12 and would thus slow the cooling process.

Four important components of the present invention are the evaporating liquid, the sorbent, the heat sink material and the wicking material. The liquid and the sorbent must be complimentary (i.e., the sorbent must be capable of absorbing or adsorbing the vapor produced by the liquid), and suitable choices for all of these components would be any combination able to make a useful change in temperature in a short time, meet government standards for safety, and be compact.

The refrigerant liquids used in the present invention preferably have a high vapor pressure at ambient temperature, so that a reduction of pressure will produce a high vapor production rate. The vapor pressure of the liquid at 20° C. is preferably at least about 9 mm Hg, and more preferably is at least about 15 or 20 mm Hg. Moreover, for some applications (such as cooling of food products), the liquid should conform to applicable government standards in case any discharge into the surroundings, accidental or otherwise, occurs. Liquids with suitable characteristics for various uses of the invention include: various alcohols, such as methyl alcohol and ethyl alcohol; ketones or aldehydes, such as acetone and aceraldehyde; water; and freons, such as freon C318, 114, 21, 114B2, 113 and 112. The preferred liquid is water.

In addition, the refrigerant liquid may be mixed with an effective quantity of a miscible boiling agent having a greater vapor pressure than the liquid to promote ebullition so that the liquid evaporates even more quickly and smoothly, and so that supercooling of the liquid does not occur. Suitable boiling agents include ethyl alcohol, acetone, methyl alcohol, propyl alcohol and isobutyl alcohol, all of which are miscible with water. For example, a combination of a boiling agent with a compatible liquid might be a combination of 5% ethyl alcohol in water or 5% acetone in methyl alcohol. The boiling agent preferably has a vapor pressure at 25° C. of at least about 25 mm Hg and, more preferably, at least about 35 mm Hg. Alternatively, solid boiling agents may be used, such as the conventional boiling stones used in chemical laboratory applications. However, the choice of boiling agent when used in conjunction with a heat sink material such as sodium acetate will be such that the nucleation source compatible with the refrigerant liquid will be incompatible with the heat sink material as to initiate a phase change of the heat sink material. Alternatively, the heat sink material will be packaged or contained within the instant invention as to prevent possible contact with a nucleation source.

The sorbent material used in the second chamber 20 is preferably capable of absorbing and adsorbing all the vapor produced by the liquid, and also preferably will meet government safety standards for use in an environment where contact with food may occur. Suitable sorbents for various applications may include barium oxide, magnesium perchlorate, calcium sulfate, calcium oxide, activated carbon, calcium chloride, glycerine, silica gel, alumina gel, calcium hydride, phosphoric anhydride, phosphoric acid, potassium hydroxide, sulfuric acid, lithium chloride, ethylene glycol and sodium sulfate.

In selecting the wicking material 16, any of a number of materials may be chosen, depending upon the requirements of the system and the particular refrigerant liquid 18 being used. The wicking material may be something as simple as cloth or fabric having an affinity for the refrigerant liquid 18 and a substantial wicking ability. Thus, for example, when the refrigerant liquid is water, the wicking material may be cloth, sheets, felt or flocking material which maybe comprised of cotton, filter material, natural cellulose, regenerated cellulose, cellulose derivatives, blotting paper or any other suitable material.

The most preferred wicking material would be highly hydrophilic, such as gel-forming polymers which would be capable of coating the interior surface of the evaporation chamber. Such materials preferably consists of alkyl, aryl and amino derivative polymers of vinylchloride acetate, vinylidene chloride, tetrafluoroethylene, methyl methacrylate, hexanedoic acid, dihydro-2,5-furandione, propenic acid, 1,3-isobenzofurandione, 1 h-pyrrole-2,5-dione or hexahydro-2 h-azepin-2-one.

The wicking material may be sprayed, flocked, or otherwise coated or applied onto the interior surface of the first chamber. In a preferred embodiment, the wicking material is electrostatically deposited onto that surface. In another embodiment, the wicking material is mixed with a suitable solvent, such as a non-aqueous solvent, and then the solution is applied to the interior surface of the first chamber.

In another preferred embodiment, the wicking material is able to control any violent boiling of the evaporator and thus reduce any liquid entrainment in the vapor phase. In such an embodiment, the wicking material is a polymer forming a porous space-filling or sponge-like structure, and it may fill all or part of the first chamber.

The total volume of sorbent 24 rises with increasing temperature. The total volume of heat sink material 40 decreases with temperature. There is, therefore, an optimum temperature rise providing minimum system volume, which is dependent upon the thermal properties of the sorbent 24 and heat sink material 40. The thermal insulator 22 may be any conventional insulation material, but is preferably an inexpensive, easily-formed material such as a low-cost polystyrene foam.

The heat transferred to the sorbent 24 is in turn collected in a phase change heat sink material 40 in association with the sorbent 24. In such materials, temperature change is discontinuous in relation to the temperature of the phase or structure change, and heat is stored in latent form. Latent heat absorption is generally accompanied by sensible heat storage in such materials.

Heat sink materials 40 with appropriate melting points absorb sensible heat in the solid phase as the materials 40 temperature rises to the melting point, absorb latent heat as the phase transformation occurs from solid to liquid, and then absorb sensible heat in its liquid phase as the temperature continues to rise.

Certain crystalline solids, when cooled from above their melting point under appropriate conditions, can be subcooled as liquids to temperatures far below the melting point of the solid, yet no phase change from liquid to crystalline solid will occur. A preferred material is sodium acetate trihydrate ($CH_3COONa \cdot 3H_2O$), a white crystalline solid with a melting point of 136° F. Sodium acetate trihydrate requires a nucleation source in order to change phase upon cooling from a liquid to a solid. In the absence of a nucleation source, the material can be cooled to below 32° F. without exhibiting the liquid to solid phase change.

For example, in the instant invention, if the operating temperature rise of the sorbent/heat sink combination is from 72° F. to 150° F,, a temperature interval of 78° F., the sodium acetate absorbs 149 BTU per pound, of which 97 BTU per pound is stored in the change of phase (crystal melting) process. Additionally, if the sodium acetate storage medium is properly packaged to eliminate nucleation, thereby preventing stored heat release by the initiation of recrystallization of the sodium acetate, the capture of the 97 Btu of the total 149 Btu of heat absorbed by each pound of sodium acetate is irreversible. The absorbed heat is captured in the suspended recrystallization process, the recrystallization prevented from being initiated by protection from nucleation.

Other inorganic crystalline materials with various melting points and heat capacities also exhibit this behavior, and are also contemplated for use in the instant invention.

In order to eliminate nucleation, in a preferred embodiment, the present invention entails packaging the sodium acetate to prevent its contact with any nucleation source. In one embodiment, this involves the separation of the sodium acetate into distinct groups or pockets of crystals, each of a sufficient size to absorb a fair proportion of the heat evolved from the process, yet physically separated so that in the event that any of the groups of crystals should not fully melt and/or have the recrystallization process initiated, the recrystallization process will be limited to within the isolated group of sodium acetate crystals, thereby not spreading throughout the entirety or other portions of the heat sink material. For instance, the heat sink material used may be localized one distinct area in thermal contact with the second chamber 20, yet be physically divided in some manner, such as through use of plastic or metal dividers, which serve to isolate each individual pocket of heat sink material. Alternatively, such "pockets" or containers of heat sink material may surround the perimeter of the inside of the second chamber 20. Alternatively, individual packets or beads of the heat sink material may be dispersed throughout the sorbent contained within the second chamber 20, in discrete, heat-permeable containers. In yet another alternative embodiment, the heat sink material may be located outside of the second chamber 20 in one or a plurality of chambers, which are thermally coupled to the sorbent material, again providing isolation of the heat sink material to prevent the initiation of nucleation throughout the heat sink material, either by an outside agency or by incomplete melting of a protion of the heat sink material.

The valve may be selected from any of the various types shown in the prior art.

The invention also includes a method of using the cooling device described herein. This method includes the step of providing a cooling device of the type set forth herein; opening the valve between the first chamber 12 and the second chamber 20, whereby the pressure in the first chamber is reduced, causing the liquid to boil, forming a vapor, which vapor is collected by the sorbent material; and removing vapor from the second chamber by collecting the same in the sorbent and collecting heat from the sorbent in a meltable phase change heat sink material, and maintaining a portion of the collected heat in said phase change material by preventing change of phase form a liquid to a solid upon cooling. The process is preferably a oneshot process; thus, opening of the valve 30 in the conduit 28 connecting the first chamber 12 and the second chamber 20 is preferably irreversible. At the same time, the system is a closed system; in other words, the refrigerant liquid does not escape the system, and there is no means whereby the refrigerant liquid or the sorbent may escape either the first chamber 12 or the second chamber 20.

Although the invention has been described in the context of certain preferred embodiments, it is intended that the scope of the invention not be limited to the specific embodiment set forth herein, but instead be measured by the claims that follow.

What is claimed is:

1. A method for removing waste heat from a sorbent used in a refrigeration apparatus, comprising the steps of:

capturing said waste heat as latent heat of fusion by melting a phase change heat sink material; and preventing release of said captured heat by preventing solidification of said phase change material upon cooling.

2. The method of claim 1, further comprising the step of thermally coupling said phase change material to said sorbent.

3. The method of claim 2, wherein said phase change material is contained in a plurality of containers.

4. The method of claim 3, wherein said containers are mixed into said sorbent.

5. A method for removing waste heat from a sorbent used in a refrigeration apparatus, comprising the step of capturing said waste heat in a sodium acetate heat sink material which is thermally coupled to said sorbent.

* * * * *